US011130919B2

(12) United States Patent
Schucker et al.

(10) Patent No.: US 11,130,919 B2
(45) Date of Patent: Sep. 28, 2021

(54) CONVERSION OF CRUDE OIL INTO LOWER BOILING POINT CHEMICAL FEEDSTOCKS

(71) Applicant: SABIC Global Technologies B.V., Bergen op Zoom (NL)

(72) Inventors: Robert C. Schucker, Sugar Land, TX (US); Sanjeev Rao, Sugar Land, TX (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/619,345

(22) PCT Filed: Jun. 5, 2018

(86) PCT No.: PCT/US2018/035946
§ 371 (c)(1),
(2) Date: Dec. 4, 2019

(87) PCT Pub. No.: WO2018/226617
PCT Pub. Date: Dec. 13, 2018

(65) Prior Publication Data

US 2020/0190412 A1 Jun. 18, 2020

Related U.S. Application Data

(60) Provisional application No. 62/515,264, filed on Jun. 5, 2017.

(51) Int. Cl.
*C10G 67/04* (2006.01)
*C10G 21/00* (2006.01)

(52) U.S. Cl.
CPC ..... *C10G 67/049* (2013.01); *C10G 21/003* (2013.01); *C10G 2300/1037* (2013.01); *C10G 2300/1077* (2013.01); *C10G 2300/1096* (2013.01)

(58) Field of Classification Search
CPC ..... B01J 2219/00006
See application file for complete search history.

(56) References Cited

U.S. PATENT DOCUMENTS

| | | | | |
|---|---|---|---|---|
| 3,132,088 | A * | 5/1964 | Beuther | C10G 21/003 208/67 |
| 4,352,729 | A | 10/1982 | Jacquin et al. | 208/209 |
| 4,659,452 | A * | 4/1987 | Howell | C10G 65/12 208/107 |
| 4,770,764 | A | 9/1988 | Ohtake et al. | 208/73 |
| 4,773,986 | A * | 9/1988 | Feldman | C10G 9/007 208/106 |
| 7,790,018 | B2 | 9/2010 | Khan | 208/89 |
| 9,228,139 | B2 | 1/2016 | Shafi et al. | |
| 9,228,140 | B2 | 1/2016 | Abba et al. | |
| 9,228,141 | B2 | 1/2016 | Sayed et al. | |
| 9,255,230 | B2 | 2/2016 | Shafi et al. | |
| 9,279,088 | B2 | 3/2016 | Shafi et al. | |
| 9,284,497 | B2 | 3/2016 | Bourane et al. | |
| 9,284,501 | B2 | 3/2016 | Sayed et al. | |
| 9,284,502 | B2 | 3/2016 | Bourane et al. | |
| 9,296,961 | B2 | 3/2016 | Shafi et al. | |
| 9,382,486 | B2 | 7/2016 | Bourane et al. | |
| 2017/0066971 | A1 | 3/2017 | Koseoglu | |

FOREIGN PATENT DOCUMENTS

| | | | | |
|---|---|---|---|---|
| CN | 1952067 | A | 4/2007 | |
| CN | 101045884 | A | 10/2007 | |
| CN | 101068908 | A | 11/2007 | |
| CN | 106753509 | A | 5/2017 | |
| WO | WO-2009003634 | A1 * | 1/2009 | C10J 3/78 |
| WO | WO2009003634 | A1 | 1/2009 | |
| WO | WO2012030414 | A1 | 3/2012 | |
| WO | WO2015000847 | A1 | 1/2015 | |
| WO | WO2015000849 | A1 | 1/2015 | |
| WO | WO2015128045 | A1 | 9/2015 | |

OTHER PUBLICATIONS

International Search Report and Written Opinion from PCT/US2018/035946 dated Jul. 23, 2018, 9 pages.
Schucker et al. "The Reactivity of Cold Lake Asphaltenes." American Chemical Society, 1981, 20 pages.
Schucker, Robert C. "Thermogravimetric Determination of the Coking Kinetics of Arab Heavy Vacuum Residuum." Ind. Eng. Chem. 22 (1983) 615-619.
Sequeira, Avilino. *Lubricant Base Oil and Wax Processing*. Marcel Dekker, Inc., New York, NY 1994.

* cited by examiner

*Primary Examiner* — Randy Boyer
(74) *Attorney, Agent, or Firm* — Norton Rose Fulbright US LLP

(57) ABSTRACT

Methods and systems of producing chemical feedstocks from crude oil can include: introducing a fraction of crude oil into a catalytic hydrovisbreaker reactor, wherein the crude oil fraction is dealkylated after introduction; introducing a product stream from the catalytic hydrovisbreaker reactor and a solvent into a solvent de-asphalter unit; and introducing de-asphalted oil from the unit into a two-stage hydrocracker to produce the chemical feedstocks. The crude oil fraction can be atmospheric residue or vacuum residue. The chemical feedstocks can include $C_3^-$ gases, $C_4$-$C_5$ gases, naphtha, BTX, and gas oil. The chemical feedstocks can be used to produce olefins and polymers.

9 Claims, 2 Drawing Sheets

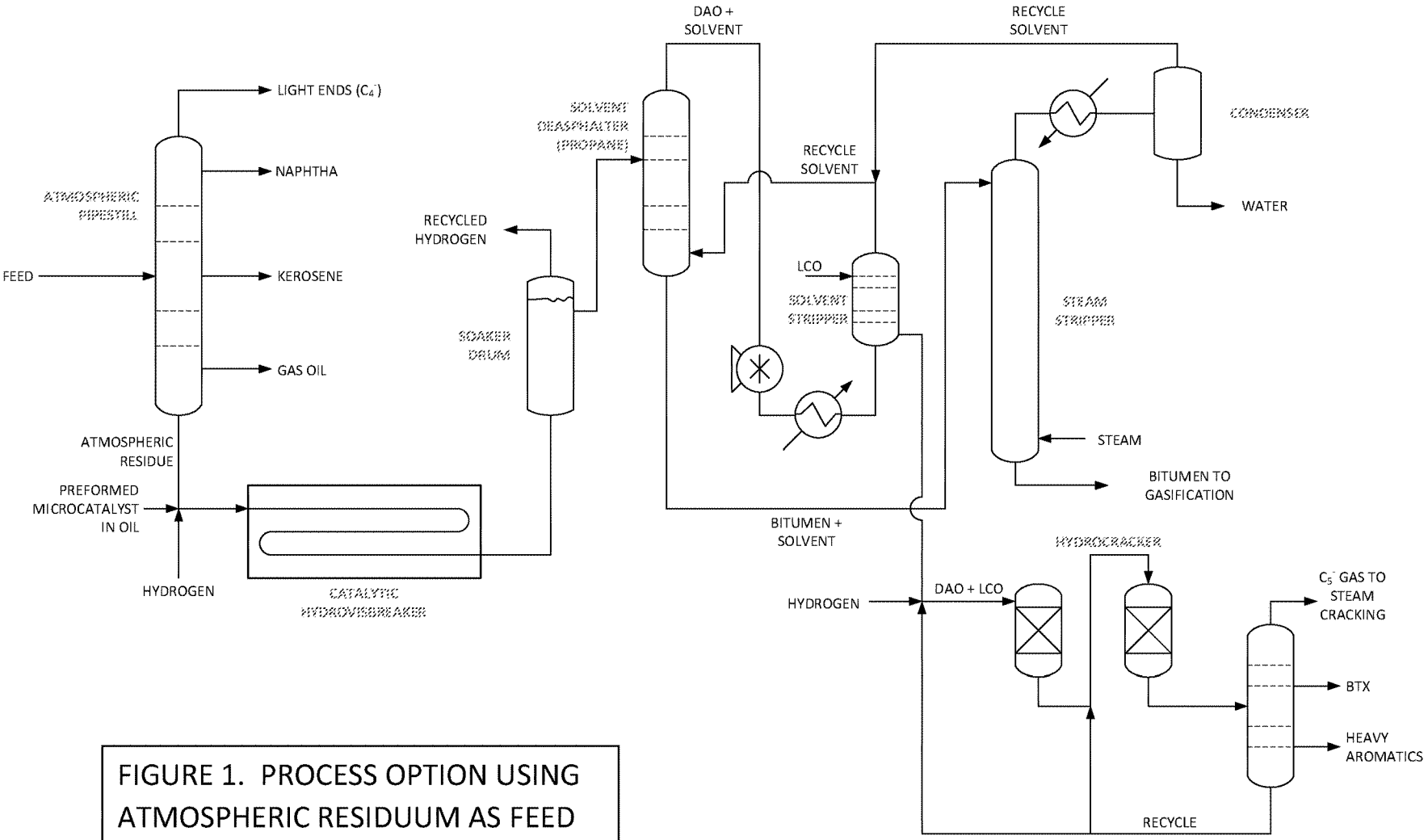
FIGURE 1. PROCESS OPTION USING ATMOSPHERIC RESIDUUM AS FEED

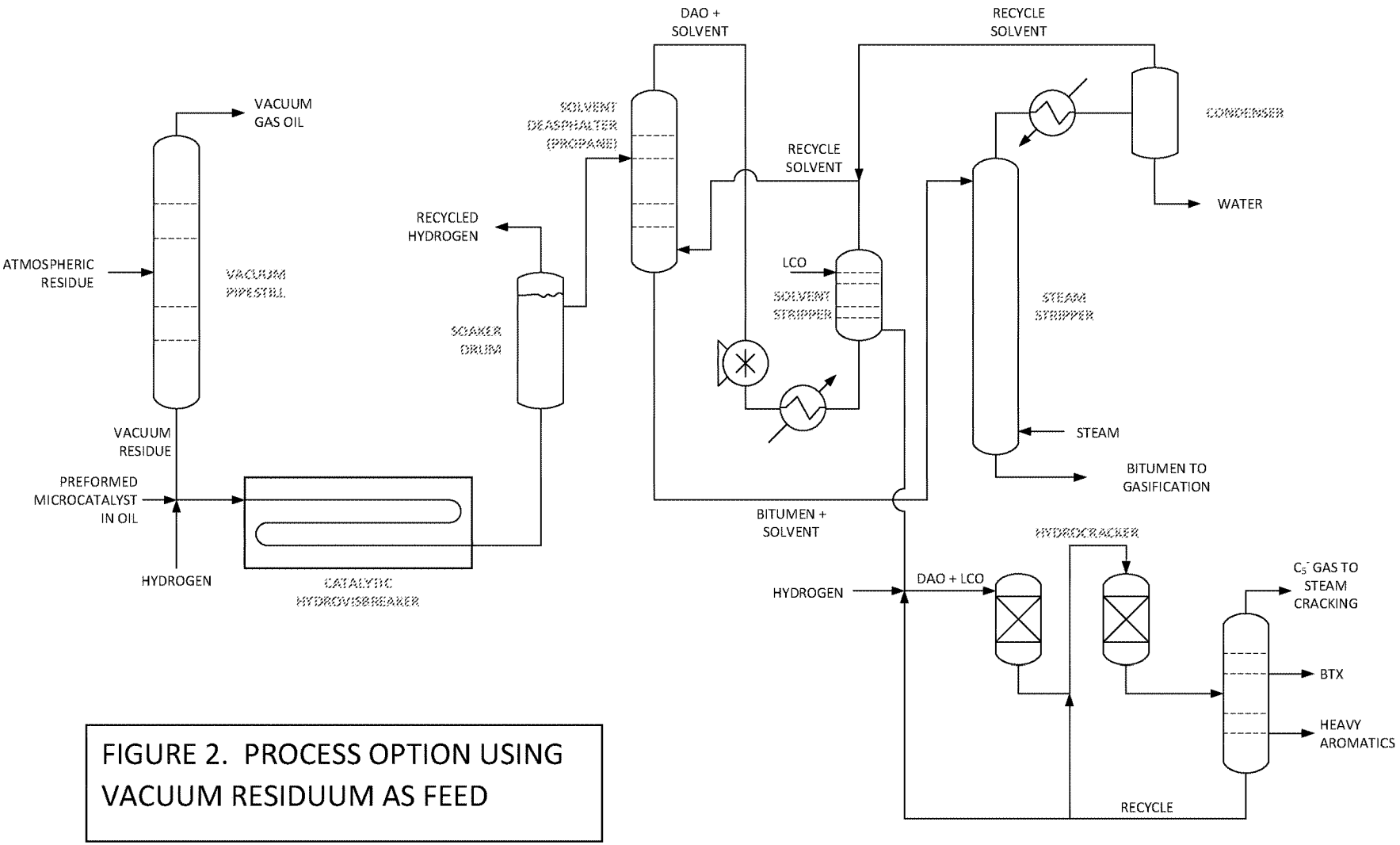
FIGURE 2. PROCESS OPTION USING VACUUM RESIDUUM AS FEED

CONVERSION OF CRUDE OIL INTO LOWER BOILING POINT CHEMICAL FEEDSTOCKS

This application is a national phase application under 35 U.S.C. § 371 of International Application No. PCT/US2018/035946 filed Jun. 5, 2018, which claims priority to U.S. Provisional Patent Application No. 62/515,264 filed Jun. 5, 2017. The entire contents of each of the above-referenced disclosures is specifically incorporated by reference herein without disclaimer.

TECHNICAL FIELD

Production of chemical feedstocks from a crude oil fraction can be produced in a series of steps. The chemical feedstocks can be used to produce syngas, polymers, and olefins. Olefins can then be used to produce industrial chemicals or plastics.

BRIEF DESCRIPTION OF THE FIGURES

The features and advantages of certain embodiments will be more readily appreciated when considered in conjunction with the accompanying figures. The figures are not to be construed as limiting any of the preferred embodiments.

FIG. 1 is a schematic diagram showing production of chemical feedstocks with crude oil as a feed.

FIG. 2 is a schematic diagram showing production of chemical feedstocks with atmospheric residue as a feed.

DETAILED DESCRIPTION OF THE INVENTION

Many chemical feedstocks are used to produce a variety of products. For example, synthesis gas (syngas) is a mixture of carbon monoxide and hydrogen that is an important intermediate used in the production of a wide variety of chemicals. Production of syngas from methane is an important, albeit energy and capital intensive process. By way of another example, olefins, such as ethylene, are one of the largest organic chemical feedstocks by volume that can be used to produce polymers, such as polyethylene, and many other chemicals and products.

However, a shortage of traditional feedstocks, such as ethane and propane, for olefin production have made the conversion of oil to chemicals (OTC) more critical. Depending on the feed, prior methods of OTC conversion have included distillation, desulfurization/heteroatom removal, hydro-conversion (including hydrocracking), and/or fluid catalytic cracking at high temperatures or steam (naphtha) cracking to produce olefins. However, OTC conversion on an industrial scale can be very costly and generally, cannot be performed at a single site or utilize existing processing units.

Crude oil can be fractionated by distillation to produce a variety of primary products. Of these primary products, some can be easily converted, for example by steam cracking, into useful secondary products; while other primary products are not easily converted or do not possess desirable qualities. Naphtha is an example of a primary product that can be easily converted into a secondary product. It is estimated that a world scale chemical plant is capable of producing 3 million tonnes per year of high-valued products using light naphtha as a feedstock. Naphtha is a low boiling stream that is recovered from crude oil by simple distillation. By contrast, heavier primary products—atmospheric residue and/or vacuum residue—do not possess desirable qualities. Thus, further processing of these residuum products poses a challenge. For example, the use of a heavier feedstock than naphtha will require actual conversion of larger molecular weight species to naphtha or lighter than naphtha and will involve a more expensive process than distillation alone. A conventional method to further process vacuum residue is coking, wherein the residue is thermally cracked in an effort to produce useful secondary products, which can be further processed into industrial chemicals or plastics. However, coking can still produce a product with inferior qualities, such as a high sulfur content, and generally requires hydrotreating in order to obtain desirable qualities.

One of the primary goals of processing heavier feedstocks, such as crude oil, atmospheric residue, and/or vacuum residue, is to have a higher conversion into aromatic and aliphatic compounds. However, the addition of a full-conversion refinery in front of a chemical complex processing unit to produce naphtha or lighter than naphtha from heavier feedstocks is prohibitively expensive—particularly if the feed is an extra heavy crude oil with an American Petroleum Institute (API) gravity of less than 5. Therefore, there is a need and an on-going industry wide concern for lower cost processes that can produce chemical feedstocks, such as ethane and propane, from crude oil and that can utilize existing processing units.

According to certain embodiments, a method of producing chemical feedstocks from crude oil comprises: introducing a fraction of crude oil into a catalytic hydrovisbreaker reactor, wherein the crude oil fraction is dealkylated after introduction; introducing a product stream from the catalytic hydrovisbreaker reactor and a solvent into a solvent de-asphalter unit; and introducing de-asphalted oil from the unit into a two-stage hydrocracker to produce the chemical feedstocks.

According to certain other embodiments, a chemical feedstocks generation system comprises: a source of a crude oil fraction; a catalytic hydrovisbreaker reactor for dealkylating the crude oil fraction; a solvent de-asphalter unit for producing de-asphalted oil from a product stream of the catalytic hydrovisbreaker reactor; and a two-stage hydrocracker for producing the chemical feedstocks from the de-asphalted oil.

It is to be understood that any discussion of the various embodiments is intended to apply to the systems and methods.

A first step in the process includes introducing a fraction of crude oil into a catalytic hydrovisbreaker reactor. FIG. 1 shows a schematic diagram of a system and methods according to certain embodiments. According to this embodiment, the process can further include introducing crude oil into an atmospheric pipe still. The crude oil can be the feed into the atmospheric pipe still. The crude oil can be medium crude oil having an American Petroleum Institute (API) gravity between about 22 and 31, heavy crude oil having an API gravity less than about 22, or extra heavy crude oil having an API gravity less than about 10. The atmospheric pipe still can produce crude oil fractions via distillation including, but not limited to, light end hydrocarbons ($C_4^-$), naphtha, kerosene, gas oil, and atmospheric residue. Atmospheric residue is generally the bottom fraction of crude oil from the atmospheric pipe still in the distillation process. Atmospheric residue can generally be considered the fraction of crude oil that has a boiling point greater than or equal to 650° F. (343.3° C.). According to this embodiment, the crude oil fraction that is introduced into a catalytic hydrovisbreaker reactor is the atmospheric residue. The other products (e.g., light end hydrocarbons, naphtha, kerosene, and gas oil) from the atmospheric pipe still can be collected, stored, and/or processed further.

FIG. 2 shows a schematic diagram of a system and methods according to certain other embodiments. As shown in FIG. 2, the methods can further include introducing atmospheric residue into a vacuum pipe still, wherein the crude oil fraction that is introduced into the catalytic hydrovisbreaker reactor is vacuum residue. The vacuum pipe still can separate via distillation the atmospheric residue into vacuum gas oil that generally has a boiling point in the range from about 650° F. to about 1,000° F. (343.3° C.-537.8° C.) and vacuum residue that generally has a boiling point greater than 1,000° F. (537.8° C.).

The methods include introducing the crude oil fraction (i.e., either the atmospheric residue or the vacuum residue) into the catalytic hydrovisbreaker reactor. The crude oil fraction can include saturates, aromatics, resins, and asphaltenes fractions. Interestingly, these fractions have significantly different physical and chemical properties. For instance, the saturate fraction from vacuum residue consists of a nonpolar material including linear, branched, and cyclic saturated hydrocarbons (paraffins). Aromatics contain one or more aromatic rings and are slightly more polarizable. Resins and asphaltenes have polar substituents with resins being miscible with heptane and asphaltenes being insoluble in heptane. The polar and asphaltene fractions have long paraffinic side chains (approximately $C_{11}$ to $C_{40}$) that can be removed via thermal cracking to form alkanes. However, traditional methods of dealkylating large aromatics (i.e., aromatics with four or more rings) to produce long chain paraffins and smaller aromatics can lead to re-combination of the radicals and undesirably form coke.

The methods can further include introducing a micro-catalyst precursor and a source of hydrogen into the catalytic hydrovisbreaker reactor with the crude oil fraction. The micro-catalyst precursor can include one or more elements or compounds that are oil-soluble, capable of forming a sulfide, and capable of transferring hydrogen atoms from the hydrogen source to crude oil fraction radical intermediates. The micro-catalyst precursor can be an organometallic species selected from the group consisting of cobalt napthenate, iron napthenate, molybdenum napthenate, and combinations thereof. The source of hydrogen can include hydrogen gas. The crude oil fraction is mixed with the oil-soluble micro-catalyst precursor to provide an atomically dispersed catalyst capable of stabilizing free radicals by hydrogen donation during the hydrovisbreaking reaction. The micro-catalyst precursor can form a metal sulfide catalyst in situ in the catalytic hydrovisbreaker reactor. The metal from the metal sulfide catalyst can stabilize the crude oil fraction radicals and reduce or eliminate coke formation during the reaction. The micro-catalyst precursor can be added to the catalytic hydrovisbreaker reactor in a concentration in the range from about 100 to about 1,000 parts per million (ppm) of the crude oil fraction.

The catalytic hydrovisbreaker reactor can be operated at a temperature in the range from about 850° F. to about 950° F. (454.4° C.-510.0° C.), a pressure from about 100 to about 2,000 pounds per square inch absolute (psia), and a residence time in the range from about 60 to about 900 equivalent seconds at 875° F.

Depending on the residence time selected, the reaction time may be too short to allow for a desired amount of conversion of the crude oil fractions into stabilized radicals. The methods can further include introducing the product stream from the catalytic hydrovisbreaker reactor into a soaker drum prior to introduction into the solvent de-asphalter unit. The soaker drum can be used to extend the residence time, typically at a temperature that is lower than the reaction temperature of the catalytic hydrovisbreaker reactor. The soaker drum temperature can be in the range from about 650° F. to about 800° F. (454.4° C.-482.2° C.). The soaker drum time can be in the range from about 0.5 to about 3 hours. The methods can further include disengaging hydrogen from the liquid product and recycling the hydrogen back into the catalytic hydrovisbreaker reactor feed. According to certain embodiments, if the product in the soaker drum contains undesirably high hydrogen sulfide ($H_2S$) content, then the methods can further include separating hydrogen and hydrogen sulfide prior to recycling the hydrogen back into the catalytic hydrovisbreaker reactor.

The methods also include introducing the product stream from the catalytic hydrovisbreaker reactor (or from the soaker drum if used) and a solvent into a solvent de-asphalter unit. The product stream from the catalytic hydrovisbreaker reactor can contain a substantial amount of alkanes, wherein the solvent de-asphalter unit can be used to selectively recover the alkanes and lighter aromatics to continue in the process. The solvent de-asphalter unit separates bitumen from the product stream because light hydrocarbon solvents will dissolve aliphatic compounds and lighter aromatics, but not the bitumen, which includes asphaltenes and polar aromatics that have been denuded. The solubilized aliphatic compounds and lighter aromatics from the solvent de-asphalter unit is called de-asphalted oil ("DAO").

The bitumen and solvent from the solvent de-asphalter unit can be introduced into a steam stripper for separating the bitumen from the solvent. The solvent can be condensed and recycled back into the solvent de-asphalter unit after separation from the bitumen. The separated bitumen can then be introduced into a gasification unit to produce syngas. The syngas can be collected and/or stored for use in other chemical processes.

The solvent for the solvent de-asphalter unit can be any solvent that solubilizes the aliphatic compounds and lighter aromatics. The solvent can be selected from propane, butane, and combinations thereof. DAO from a propane solvent can produce the highest quality products, but the lowest yield; whereas using butane as a solvent may double or triple the yield from the feed, but at the expense of contamination by metals and carbon residues that shorten the life of downstream cracking catalysts. The ratio of the product stream from the catalytic hydrovisbreaker reactor (or soaker drum) to solvent can be in the range from about 1:3 to about 1:8. The solvent de-asphalter unit can be operated at a temperature and pressure that is less than the critical temperature and pressure of the solvent selected. By way of example, the critical temperature of propane is 96.7° C. and its critical pressure is 42.5 bar (624 psia); therefore, the operation of the solvent de-asphalter can be about 50° C. and 200-300 psia.

The methods can further include introducing the de-asphalted oil (DAO) and solvent into a solvent stripper after leaving the solvent de-asphalter unit. The DAO in the solvent is then compressed to a pressure above the critical pressure of the solvent (e.g., propane), then heated to a temperature above the critical temperature of the solvent at which point the supercritical solvent is no longer capable of dissolving the DAO and the two phases separate. A light cat cycle oil (LCO) can be introduced into the solvent stripper wherein the LCO solubilizes the DAO. The solvent from the solvent de-asphalter unit can then be recycled back into the solvent de-asphalter unit. The LCO/DAO solution can be removed from the bottom of the solvent stripper and fed into the two-stage hydrocracker.

The methods also include introducing the de-asphalted oil, and optionally the light-cycle oil, into the two-stage hydrocracker. Hydrocracking is a catalytic cracking process assisted by the presence of added hydrogen gas, where the catalyst is used to break C—C bonds. Thus, hydrocarbon feed stocks that have relatively high molecular weights (e.g., catalytic cycle oils with a boiling point between about 350° F. and 850° F.) are converted to lower-molecular-weight hydrocarbons at elevated temperature and pressure in the presence of a hydrocracking catalyst and the hydrogen-containing gas. Hydrogen is consumed in the conversion of organic nitrogen and sulfur to ammonia and hydrogen sulfide, respectively, in the splitting of high-molecular-weight compounds into lower-molecular-weight compounds, and in the saturation of olefins and other unsaturated compounds.

The two-stage hydrocracker employs two processing stages. In the first stage, the de-asphalted oil (DAO) feed is hydro-treated to remove heteroatoms, such as nitrogen and sulfur, that are typically found in the feed. The second stage of the two-stage hydrocracker hydrocracks the product stream from the first stage into a lower boiling point product stream from the second stage. Therefore, the first stage is considered a feed-preparation stage and the second stage is considered a hydrocracking stage.

The unit for the first stage of the two-stage hydrocracker can be a fixed bed reactor including a standard hydro-treating catalyst, such as a cobalt/molybdenum sulfide on alumina or nickel/molybdenum sulfide on alumina. The reactor unit for the first stage can be operated at a temperature in the range from about 600° F. to about 750° F. (315° C.-400° C.), a pressure in the range from about 200 to about 1,500 psia, hydrogen/feed ratios of about 0.1 to about 0.3 $Nm^3/kg$, and weight hourly space velocity of about 6.7 to about 14 weight units of hydrocarbon feed per hour per weight unit of catalyst. The reactor unit for the first stage can also have a liquid hourly space velocity in the range of about 0.5 to about 5 volume of hydrocarbon feed per hour to volume of catalyst.

The second stage of the two-stage hydrocracker can be operated at a temperature in the range of about 450° F. to about 750° F. (232.2° C.-398.9° C.), a pressure in the range of about 200 to about 2,500 psia, and a liquid hourly space velocity between about 0.2 and 5.0 volumes of hydrocarbon per hour per volume of catalyst. A suitable hydrocracking catalyst, for example, $NiS/MoS_2$ or Pt on a silica-alumina support, can be used in the second stage hydrocracking reactor.

The product stream from the second stage of the two-stage hydrocracking process can be introduced into a distillation column to separate the products. The distillation can produce a first chemical feedstock comprising $C_3^-$ gases. The first chemical feedstock can then be introduced into an ethane cracker to produce olefins. According to certain embodiments, if the first chemical feedstock includes methane, then the methane gas is separated from ethane gas and propane gas by distillation prior to introduction into the ethane cracker.

The distillation can also produce a second chemical feedstock comprising $C_4$-$C_5$ gases, naphtha, and BTX (benzene, toluene, and xylene isomers). The second chemical feedstock can then be introduced into a naphtha cracker to produce olefins. According to certain embodiments, the BTX is separated from $C_4$-$C_5$ gases and naphtha by liquid/liquid extraction prior to introduction into the naphtha cracker. The separated BTX can be used to produce polymers.

The distillation can also produce a third chemical feedstock comprising gas oil. The gas oil can be recycled back into the second stage of the two-stage hydrocracker.

Some of the advantages of the systems and methods according to the various embodiments include: an ability to produce feedstocks from crude oil that are useful in producing other chemicals, such as olefins and polymers; a more economical way to produce the feedstocks; and an ability to utilize existing processing equipment as disclosed in the novel methods without the need for larger scale or full-conversion refineries located near a chemical complex processing unit. It will be appreciated by those skilled in the art, that the embodiments disclosed herein are useful and beneficial in converting heavy hydrocarbon feeds into useable chemical feedstocks in a cost-efficient and less complex manner.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more stages, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A chemical feedstocks generation system comprising: a source of a crude oil fraction;

a catalytic hydrovisbreaker reactor for dealkylating the crude oil fraction;

a solvent de-asphalter unit for producing de-asphalted oil from a product stream of the catalytic hydrovisbreaker reactor; and a two-stage hydrocracker for producing the chemical feedstocks from the de-asphalted oil;

wherein the de-asphalted oil and a light cycle oil are introduced into a first stage of the two-stage hydrocracker.

2. The chemical feedstocks generation system according to claim 1, wherein the solvent de-asphalter comprises a solvent.

3. The chemical feedstocks generation system according to claim 1, wherein the catalytic hydrovisbreaker comprises a micro-catalyst precursor.

4. The chemical feedstocks generation system according to claim 1, further comprising introducing atmospheric residue into a vacuum pipe still, wherein the crude oil fraction is vacuum residue.

5. The chemical feedstocks generation system according to claim 3, wherein the micro-catalyst precursor comprises one or more elements or compounds that are oil-soluble, capable of forming a sulfide, and capable of transferring hydrogen atoms to crude oil fraction radicals.

6. The chemical feedstocks generation system according to claim 5, wherein the one or more elements or compounds are selected from cobalt naphthenate, iron naphthenate, molybdenum napthenate, and combinations thereof.

7. The chemical feedstocks generation system according to claim 2, wherein the solvent is selected from the group consisting of propane and butane, and combinations thereof.

8. The chemical feedstocks generation system according to claim 2, wherein the solvent de-asphalter unit comprises bitumen.

9. The chemical feedstocks generation system according to claim 2, wherein the solvent comprises butane.

* * * * *